United States Patent [19]

Knürr

[11] Patent Number: 4,984,833

[45] Date of Patent: Jan. 15, 1991

[54] LOCK HOOK

[75] Inventor: Hans Knürr, Kirchheim, Fed. Rep. of Germany

[73] Assignee: Knürr-Mechanik für die Elektronik Aktiengesellschaft, Munich, Fed. Rep. of Germany

[21] Appl. No.: 413,610

[22] Filed: Sep. 28, 1989

[30] Foreign Application Priority Data

Sep. 30, 1988 [DE] Fed. Rep. of Germany ..... 3833283

[51] Int. Cl.[5] ..... E05C 19/12

[52] U.S. Cl. ..... 292/96; 292/DIG. 68; 292/127

[58] Field of Search ..... 292/96, 119, 97, 127, 292/98, 135, 99, 221, 179, 195, 112, 227, 237, 337, DIG. 68, 216

[56] References Cited

U.S. PATENT DOCUMENTS

| | | | |
|---|---|---|---|
| 1,672,901 | 6/1928 | North | 292/227 |
| 2,115,947 | 5/1938 | Ellison | 292/DIG. 68 |
| 2,647,789 | 8/1953 | Chayne | 292/96 X |
| 2,983,000 | 5/1961 | Metzler | 292/96 X |
| 3,339,956 | 9/1967 | Bencene et al. | 292/127 |
| 3,884,056 | 5/1975 | East et al. | 292/98 X |
| 3,899,201 | 8/1975 | Paioletti | 292/337 |
| 3,907,346 | 9/1975 | Van Klompenburg | 292/127 |
| 3,988,854 | 11/1976 | Peterson | 292/227 X |
| 4,003,614 | 1/1977 | Geer et al. | 292/97 X |
| 4,177,656 | 12/1979 | Davis | 292/337 |

FOREIGN PATENT DOCUMENTS

| | | | |
|---|---|---|---|
| 622197 | 11/1935 | Fed. Rep. of Germany | 292/97 |
| 2918272 | 11/1979 | Fed. Rep. of Germany | 292/96 |
| 854226 | 11/1960 | United Kingdom | 292/98 |

*Primary Examiner*—Eric K. Nicholson

*Attorney, Agent, or Firm*—Fleit, Jacobson, Cohn, Price, Holman & Stern

[57] ABSTRACT

A lock hook for a door of a computer cabinet is described. The lock hook is pivotable about a pivot axis into a closed and an open position. Commonly, locking devices project out of the main surface of the door of computer cabinets when the lock hooks thereof are in the open position. The present invention solves this problem by pivoting the lock hook completely into an opening in the main surface of the door.

19 Claims, 2 Drawing Sheets

LOCK HOOK

BACKGROUND OF THE INVENTION

The invention relates to a lock hook for a computer cabinet door.

Such lock hooks are mainly used in computer cabinets, EDP furniture, etc., in order to permit a reliable and secure locking action between the door and the cabinet frame, because it is frequently necessary to have a dust-tight and possibly also a high frequency seal.

However, in their open positions, known lock hooks can only be swivelled to such an extent that the hook-like area still projects over the main face of the corresponding object, e.g. the door or computer cabinet surface. This area, projecting out of the main face in the open position, constitutes an obstacle during assembly work, as well as a point where damage and injury can occur.

Moreover, the lock hook is typically mounted directly in an opening provided in the door or computer cabinet or the spars thereof. Thus, on completing the computer or EDP cabinet, the fitting of the corresponding small parts and connections requires time, which should appropriately be taken up during an earlier stage of the manufacturing process. This also applies with regards to the repair and maintenance work on the hitherto used lock hooks.

SUMMARY OF THE INVENTION

The problem addressed by the present invention is therefore to design the lock hook so that there is no possibility of injury and damage on the lock hook in its open position and at the same time simplifying the fitting of the lock hook to the door or cabinet. According to the invention this problem is solved by the characterizing features presented herein.

An important basic concept of the invention is to so design the lock hook with its outer contour and adaptation to the position of the pivot pin or axis, that in the open position it is located within the outer face of the corresponding object, e.g. the door or cabinet spar. In order to simplify fitting, the lock hook, including its lock plate, is produced in the form of a prefabricated assembly and consequently the lock plate can be fixed with a few manipulations in the complimentary opening of the corresponding door or cabinet surface. Appropriately only a screw fastening, e.g., one in the lower part of the lock plate is chosen whereas an undercut engaging slot is provided in the upper lock plate area.

In this lock hook design, it is ensured that there is a planar main face of the door or computer cabinet in the opened state. The prefabricated assembly constituted by the lock hook and lock plate can still be inserted and fixed very rapidly in the door plate or leaf or the corresponding panel, so that relatively complicated work relating to the fixing of the actual lock hook in the lock plate can be carried out at an earlier stage in the manufacturing process.

The aforementioned lock hook is generally provided with two engagement openings, one engagement opening being in operative connection with an actuating device, which can e.g. be constructed as a push rod, so that in the case of a vertical displacement of the push rod it is possible to bring about a pivoting movement of the lock hook and therefore an opening or closing thereof. The second engagement area is positively connected to a closing or locking pin in the closed position, which ensures that the locking function is achieved.

Obviously the lock hook can be fitted in the door and locking can take place by engagement with a locking pin of the computer cabinet or a spar. A reversal of this principle is also conceivable, i.e. a mounting support of the lock hook in a spar of the cabinet with a corresponding hook engagement in a door.

With a view to the lock hook stability, in the simplest case it is merely necessary to construct the lock hook as a flat stamping, the necessary contours and openings being made in one operation. In order to bring about a more favourable engagement with the actuating device, said lock hook area can also be forked. In this embodiment the swivelling force can be applied largely at right angles to the pivot pin or axis and oblique forces on the lock hook are avoided.

As conventionally the hook area of the lock hook has an outwardly directed opening in the closed position, the engagement areas for the push rod and the locking pin are appropriately positioned above the pivot axis. However, a reversal of this principle and an engagement of the locking pin from below through the hook area is also possible.

In order to permit a reliable engagement of the locking pin at an early time, the hook area has an engagement bevel, provided in its interior with a substantially positive contour to the locking pin, so that the closed or locked position can be reliably maintained. In order to avoid frictional forces between the closing pin and the hook area during a closing and opening movement, a roller is appropriately fitted in a rotary manner to the closing pin, but is axially fixed. In the case of contact with a sloping face of the hook area, the roller permits a rotary movement on the closing pin, so that frictional forces are largely avoided. Appropriately the engagement bevel passes with a slight undercut into the inner area of the hook. This leads to a reliable locking or hooking of the lock hook about the outer contour of the roller located on the locking pin.

The engagement area of the lock hook for the actuating device is, considered in the closed position, provided with a lever positioned level with the pivot pin or axis and is used for applying the opening force in the case of a vertical downward movement of the push rod. The upper area of the engagement means has a closing path guide enabling the latter to be brought from the open in to the closed position in the case of a vertically upwardly directed movement of the push rod.

The pivot axis of the lock hook is appropriately inwardly displaced from the outer contour, so that there is at least an adequate distance for pivoting and lowering the lock hook or its lower edge with respect to the corresponding outer contour of the lock plate. The latter contains a narrow, elongated opening, which is used for receiving the lock hook, at least over its length between the pivot axis and the hook area. The engagement area of the lock hook for the actuating device, such as a push rod, can be so constructed that it comes to rest in the open position in the cavity, e.g. of the door. With a view to a favourable swivelability and lowerability of the lock hook in its open position, the pivot pin is provided in the lower region of the lock plate opening and the contour of the lower edge, including the lock hook area, is so constructed that there is no projection over the outer contour or main face of the lock plate in the opening. With a view to obtaining a favourable force transfer and guidance, but also to ensure a reliable closed position, the engagement areas in the closed position with the push rod or the locking pin are at least partially positive with respect thereto.

BRIEF DESCRIPTION OF THE DRAWINGS

The invention is described in greater detail hereinafter relative to the two diagrammatic drawings.

DETAILED DESCRIPTION OF THE INVENTION

Figure 1:
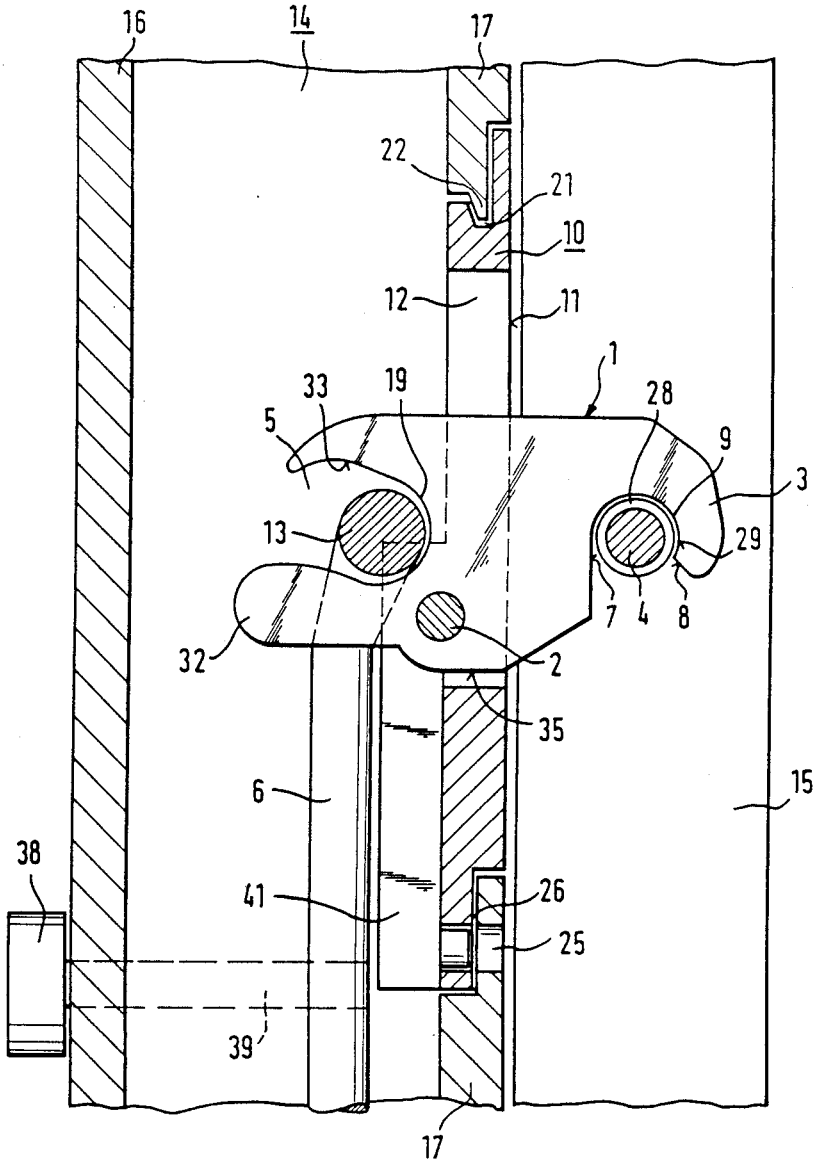
FIG. 1 shows a vertical section in the vicinity of a lock plate of a cabinet shown in fragmentary form and which can be closed by means of a door and a corresponding lock hook, the details of the lock hook being shown in its closed position.

FIG. 1 is a fragmentary vertical section through a door 14 in a closed position with respect to a cabinet 15 or a spar thereof. The locking of door 14 with respect to cabinet 15 is realized in the present case by a centrally arranged lock hook 1, which is substantially horizontal in the represented closed position.

Lock hook 1 is fixed in door 14 by means of a lock plate 10, which has in the upper area a slot-like undercut 21 for a positive positioning with respect to a projection 22 of the door panel 17 and in the lower area is provided with an overlap zone 26 with said panel 17.

In a plan view from the left, the lock plate 10 has a not shown, narrow elongated form, on whose lower area are provided two webs 41, between which extends a recess, which passes into the opening 12 in the upper part. In the lower area of said opening, a bolt or pin 2 is fixed as the pivot pin for the lock hook 1 in lock plate 10, displaced in the direction of webs 41. About the bolt 2, the lock hook 1 can be moved into its open or closed position as a result of the operative connection with a vertically operable push rod 6. Push rod 6 has at its upper end a sectionally circular driver or dog 13, which engages with the opening area 5.

The actuation of the push rod 6 in the vertical direction e.g. takes place by means of a knob 38 and an intimated spindle 39, which has a screw or rack engagement with the push rod 6 for the vertical displacement thereof. The knob 38 is fitted to the outside of the outer door panel 16.

The engagement area 5, which always comes to rest in the cavity of door 14, has an elongated and curved opening, which in the direction of the lock plate 10 has a substantially positive rounded portion 19 for receiving the driver 13. In the lower area is provided a lever arm 32 projecting to the left roughly horizontally away from the bolt 6. The upper part of the engagement area is formed by a closed path guide 33.

In the represented closed position, the hook area 3 projects roughly horizontally out of the lock plate 10. Hook area 3 engages in said position positively round a closing or locking pin 4 located in inner area 9. Opening 7 of the hook area is roughly circular, but expands in the downwards direction, and an engagement bevel 8 is provided for easier engagement of the round closing pin 4 during the closing movement.

An axially fixed, rotary roller 28 is provided on the closing pin 4. The outer contour of roller 28 is positively engaged against the inner part 9 of the hook area in the closed position. At the transition to the engagement bevel 8, there is a slight undercut 29 of the inner area, so as to obtain a reliable engagement of lock hook 1 in the closed position. In other words, the positive inner area 9 in the present case extends over an angular range of 200°. The undercut 29 is chosen in such a way that a slightly higher force permits the engagement of roller 28 in the inner hook area 9. As a result of roller 28, there are very small frictional forces generated during opening and closing movement, because on engagement of the roller 28 with the engagement bevel 8 or undercut 29, there is a rotary movement of roller 28.

In the vicinity of the opening 12, the lower edge 35 of lock hook 1 runs approximately horizontal and has an upwardly sloping transition into the opening 7 of hook area 3.

Thus, from the fitting or assembly standpoint, the lock hook 1, already preassembled by means of bolt 2 in lock plate 10, can be easily inserted into the inner door panel 17 with a positive engagement in the upper part and an overlap in the lower part and can e.g. be fixed in the door by means of a screw through the fastening opening 25.

Figure 2:
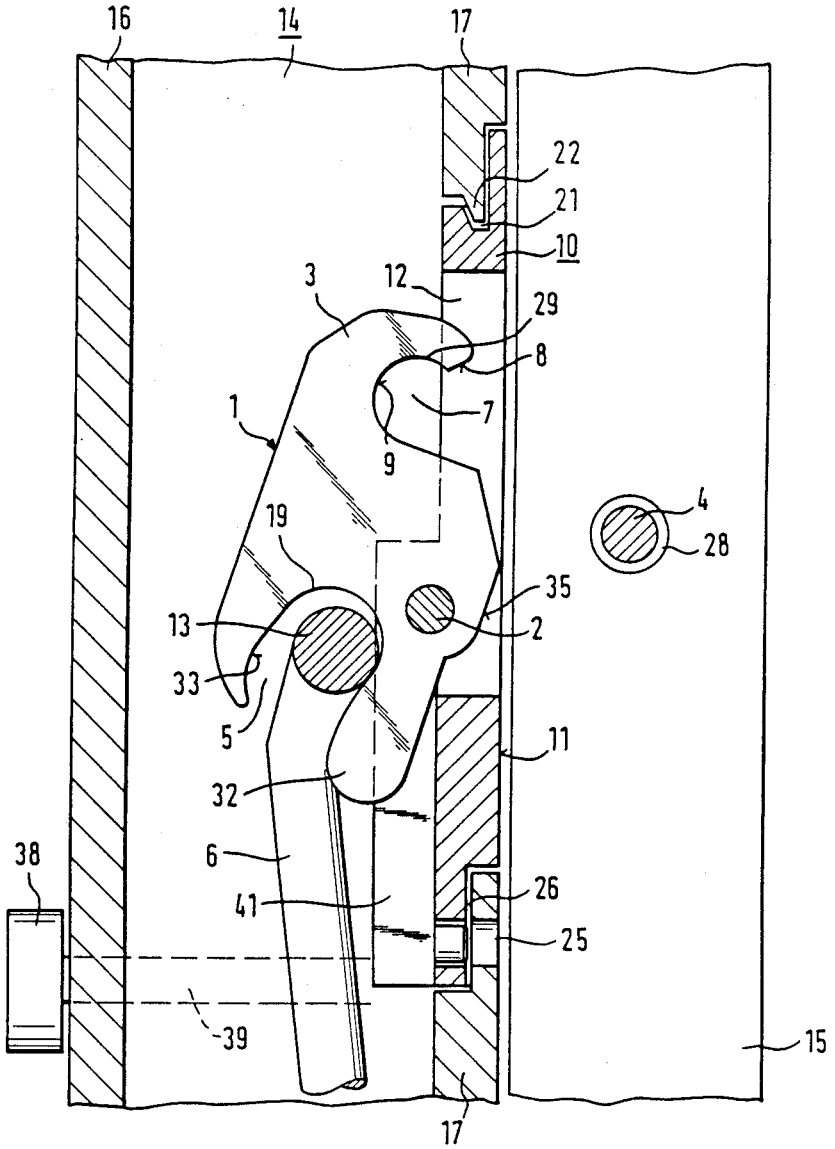
FIG. 2 shows the section according to FIG. 1, but with the lock hook open.

In the present embodiment, the opening force is applied by a displacement of push rod 6 in a roughly vertically downwards direction by its driver 13, which is parallel to the pivot axis in bolt 2. The driver 13 engages lever arm 32, so that the latter is pivoted downwards. Simultaneously there is disengagement between hook area 3 and closing pin 4. This pivoting takes place over a range of approximately 90°, so that in the complete open position the complete hook area 3 and the lower edge 35 of the lock hook 1 are located within the opening 12 and face 11, facing the spar 15, as shown in FIG. 2. The closing force is applied by an upward movement of the push rod on the closing path guide 33 and in the represented closed position the locking pin 4 is partly positively received in opening 7 of the hook area.

The design of the plate-like lock hook as a subassembly with the lock plate 10 consequently permits a simple, uncomplicated fitting and also a complete countersinking of the lock hook within the outer face of door 14.

What is claimed is:

1. In combination with a door and a cabinet, a lock plate having a face aligned with an inner face of said door and including an opening in an upper part thereof, a pivot pin fixed within said opening, a locking pin provided on said cabinet, an actuating device, and a lock hook comprising a lower lever arm and an upper closed path guide surrounding an engagement area for engagement with said actuating device, said engagement area being elongated and curved in shape and receiving the actuating device, said lock hook being pivotable, in said opening, about said pivot pin between a closed position and an open position, said lock hook having a hook area for engagement with said locking pin, the hook area projecting beyond the face of the lock plate when said lock plate is in said closed position, the hook area being pivotable into the lock plate so that the hook area does not project beyond said face of said lock plate when said lock hook is in said open position, said lock plate and said lock hook being preassembled as a subassembly which is inserted in the door of said cabinet.

2. A combination according to claim 1, wherein said lock hook is constructed as a flat stamping.

3. A combination according to claim 1, wherein the hook area and the engagement area, in the closed position of the lock hook, are disposed laterally of the pivot pin.

4. A combination according to claim 1, wherein the hook area, in the closed position of the lock hook, has a downwardly oriented opening which has an engagement bevel for engaging the locking pin as the lock hook is pivoted into said closed position, and an inner area with a contour roughly fitting the locking pin.

5. A combination according to claim 1, wherein the pivot pin is provided in a lower marginal region of the opening.

6. A combination according to claim 1, wherein said lock hook has a lower edge resting within the opening in the open position of the lock hook.

7. A combination according to claim 1, wherein in the closed position of the lock hook, a fitted engagement is present between the locking pin and the hook area as well as between the actuating device and the engagement area.

8. A combination according to claim 1, and further comprising a roller provided on said locking pin for engagement with an inner part of the hook area.

9. A combination according to claim 1, wherein the hook area has an undercut for the locking pin.

10. A combination according to claim 1, wherein said engagement area is formed from a forked metal part of said lock hook.

11. A combination according to claim 7, wherein the fitted engagement extends over a roughly semi-circular area.

12. In combination with a door and a cabinet, a lock plate having a face aligned with an inner face of said door and including an opening in an upper part thereof, a pivot pin fixed within said opening, a locking pin provided on said cabinet, an actuating device, a lock hook constructed as a flat stamping and pivotable about said pivot pin between a closed position and an open position, said lock hook having a hook area for engagement with said locking pin and an engagement area for engagement with said actuating device, the hook area, in the closed position of the lock hook, having a downwardly oriented opening which has an engagement bevel for engaging the locking pin as the lock hook is pivoted into said closed position, and an inner area with a contour roughly fitting the locking pin, and a roller provided on said locking pin for engagement with an inner part of the hook area, the hook area projecting beyond the face of the lock plate when said lock plate is in said closed position, the hook area being pivotable relative to the lock plate, so that the hook area does not project beyond said face of said lock plate when said lock hook is in said open position, said lock plate and said lock hook being preassembled as a subassembly which is inserted in the door of said cabinet, wherein the opening in said lock plate is elongated and substantially adapted to the thickness of the lock hook, the lock hook being pivoted into said opening when in said open position.

13. A combination according to claim 12, wherein the hook area has an undercut for the locking pin.

14. A combination according to claim 12, wherein the hook area and the engagement area, in the closed position of the lock hook, are disposed laterally of the pivot pin.

15. A combination according to claim 12, wherein said lock hook has a lower edge resting within the opening in the open position of the lock hook.

16. A combination according to claim 12, wherein in the closed position of the lock hook, a fitted engagement is present between the locking pin and the hook area as well as between the actuating device and the engagement area.

17. A combination according to claim 12, wherein said engagement area is formed from a forked metal part of said lock hook.

18. A lock hook according to claim 7, wherein the fitted engagement extends over a roughly semi-circular area.

19. In combination with a door and a cabinet, a lock plate having a face aligned with an inner face of said door and including an opening in an upper part thereof, a pivot pin fixed within said opening, a locking pin provided on said cabinet, an actuating device, a lock hook constructed as a flat stamping and pivotable about said pivot pin between a closed position and an open position, said lock hook having a hook area for engagement with said locking pin and an engagement area for engagement with said actuating device, said lock hook comprising a lower lever arm and an upper closed path guide surrounding said engagement area, said engagement area being elongated and curved in shape and receiving the actuating device, and a roller provided on said locking pin for engagement with an inner part of the hook area, the hook area projecting beyond the face of the lock plate when said lock plate is in said closed position, the hook area being pivotable relative to the lock plate, so that the hook area does not project beyond said face of said lock plate when said lock hook is in said open position, said lock plate and said lock hook being preassembled as a subassembly which is inserted in the door of said cabinet, wherein the opening in said lock plate is elongated and substantially adapted to the thickness of the lock hook, the lock hook being pivoted into said opening when in said open position.

* * * * *